US007249983B2

(12) United States Patent
Meyer et al.

(10) Patent No.: US 7,249,983 B2
(45) Date of Patent: Jul. 31, 2007

(54) SLEEVELESS STAMPED AND FORMED SOCKET CONTACT

(75) Inventors: David G. Meyer, Perris, CA (US); Brice I. Byford, Romoland, CA (US); David L. Marshall, Foothill Ranch, CA (US); Robin D. Reed, Banning, CA (US)

(73) Assignee: Deutsch Engineered Connecting Devices, Hemet, CA (US)

( * ) Notice: Subject to any disclaimer, the term of this patent is extended or adjusted under 35 U.S.C. 154(b) by 0 days.

(21) Appl. No.: 11/134,828

(22) Filed: May 19, 2005

(65) Prior Publication Data

US 2006/0264124 A1 Nov. 23, 2006

(51) Int. Cl.
*H01R 4/10* (2006.01)

(52) U.S. Cl. ..... 439/878; 439/748; 439/851

(58) Field of Classification Search ..... 439/843, 439/851, 852, 877, 878, 748
See application file for complete search history.

(56) References Cited

U.S. PATENT DOCUMENTS 3,406,376 A * 10/1968 Varrin ..... 439/852
4,447,110 A 5/1984 Punako et al.
4,666,227 A * 5/1987 Galizia et al. ..... 439/252
4,780,097 A 10/1988 Piscitelli
4,838,816 A * 6/1989 Matsusaka et al. ..... 439/861
5,135,418 A 8/1992 Hatagishi et al.
5,147,230 A * 9/1992 Plyler et al. ..... 439/843
5,217,382 A * 6/1993 Sparks ..... 439/161
5,509,814 A 4/1996 Mosquera
5,529,517 A * 6/1996 Hopf et al. ..... 439/843
5,540,603 A 7/1996 Fujiwara
5,601,458 A * 2/1997 Ohsumi et al. ..... 439/852
5,839,925 A * 11/1998 Simmons ..... 439/852
6,116,970 A * 9/2000 Yamamoto et al. ..... 439/852
6,152,788 A * 11/2000 Hata et al. ..... 439/852
6,171,155 B1 * 1/2001 Miwa et al. ..... 439/852
6,325,680 B1 12/2001 Suzuki
6,558,208 B2 * 5/2003 Suzuki ..... 439/878

FOREIGN PATENT DOCUMENTS

| | | |
|---|---|---|
| EP | WO 99/31766 | 6/1999 |
| EP | 0932917 | 5/2000 |
| FR | 1539296 | 9/1968 |
| GB | 2264007 | 8/1993 |
| JP | 3-291874 | * 12/1991 |

* cited by examiner

*Primary Examiner*—Tho D. Ta
(74) *Attorney, Agent, or Firm*—O'Melveny & Myers LLP

(57) ABSTRACT

An electrical contact includes a crimping section for securing a wire and a flute section for receiving a pin. The flute section includes fixed engagement members and a resilient cantilever member that engages the pin within the flute section.

12 Claims, 7 Drawing Sheets

SLEEVELESS STAMPED AND FORMED SOCKET CONTACT

BACKGROUND OF THE INVENTION

1. Field of the Invention

The present invention relates to a sleeveless stamped and formed socket contact.

2. Description of Related Art

Electrical contacts are used to connect terminal ends of wires together. Some electrical contacts are attached to exposed ends of wire by crimping where the exposed wire is inserted into a crimping portion of the electrical contact, and then pinching a crimping member to secure the wire therein. The contacts may be male (pins) and female (sockets).

Manufacturers of stamped and formed socket contacts are concerned with reducing production costs without reducing product quality. There currently exists a need to improve the sleeve design of stamped and formed socket contacts and to reduce the manufacturing costs in sleeve component assembly operations. Stamped and formed socket contacts have used stainless steel sleeves to cover and protect the socket finger region. Socket sleeves add production costs from materials and supplemental assembly operations.

The present invention provides a sleeveless design that obviates the need for sleeve component and assembly.

SUMMARY OF THE INVENTION

The present invention is directed to an connection socket contact component, such as a sleeveless stamped and formed socket contact. The socket contact includes a crimping section for securing exposed wire and a flute section for receiving a pin. The flute section includes fixed engagement members and a resilient cantilever member that provides an electrical engagement zone for the pin within the flute section.

In one aspect, the crimping section includes insulation crimping members that secure an insulative portion of the wire to the electrical contact. The insulation crimping members overlap with minimal collision when crimped into position around the insulative portion of the wire. The insulation crimping members include tapered edges.

In another aspect, the crimping section includes conductor crimping members that secure an exposed conductive portion of the wire to the electrical contact. The conductor crimping members include at least one of an arched side edge, a tapered side edge, and a reduced edge thickness. The crimping section includes one or more ribs or grooves that prevent sliding movement of the wire after crimping.

In still another aspect, the fixed engagement members protrude inward from a sidewall of the flute section. The fixed engagement members are elongate, semi-cylindrical shaped protrusions on the interior surface of the flute section and appear as recesses on the exterior surface of the flute section. The fixed engagement members define an elongate area of contact along its length and width. The fixed engagement members define at least two fixed contact points or areas, aligned with the longitudinal contact axis.

In yet another aspect, the resilient cantilever member bends inward from a sidewall of the flute section. The flute section includes a tab member that limits outward deflection of the resilient cantilever member when the pin is received by the flute section. The resilient cantilever member defines at least two moving contact points or areas.

Other features and advantages of the invention will be apparent from the following detailed description, taken in conjunction with the accompanying drawings which illustrate, by way of example, various features of embodiments of the invention.

DETAILED DESCRIPTION OF THE INVENTION

Reference will now be made to the drawings wherein like numerals refer to like parts throughout.

Figure 1:
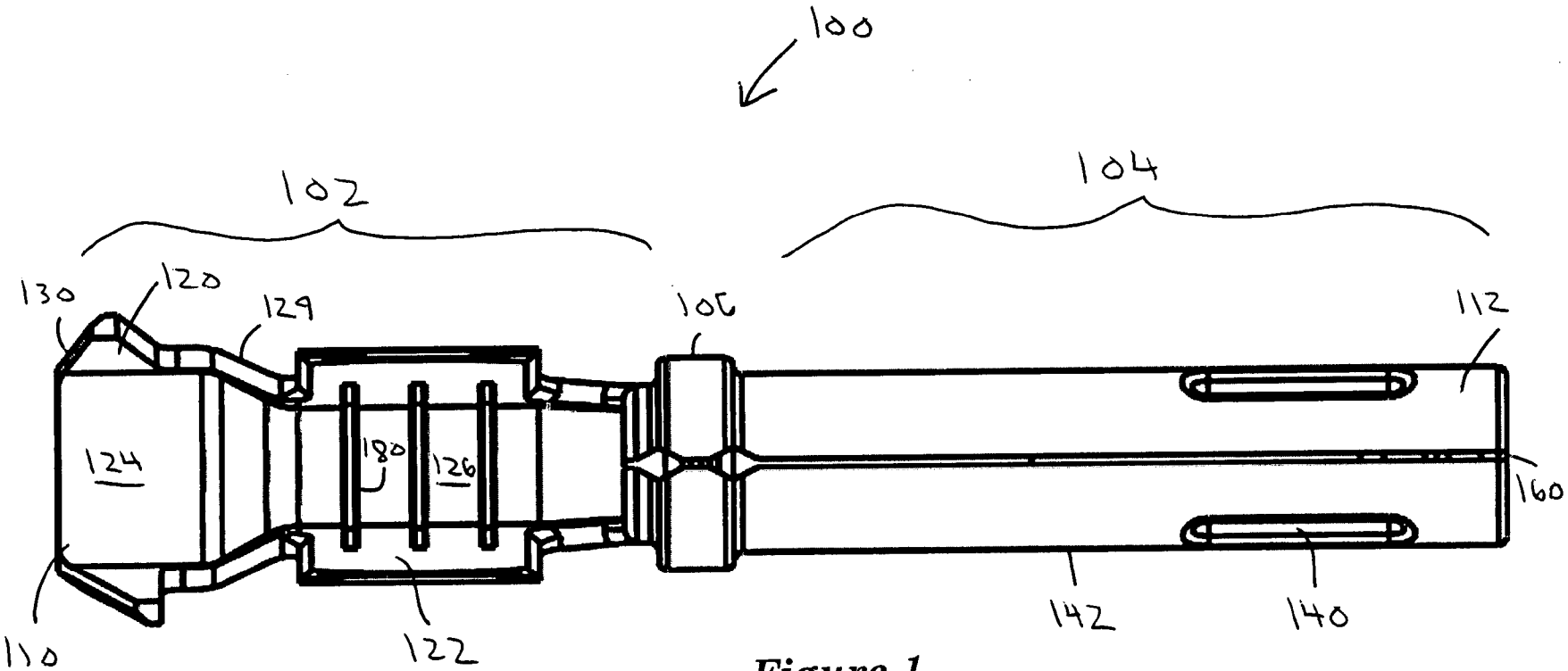
FIG. 1 is a top view of a socket contact according to the present invention.
Figure 2:
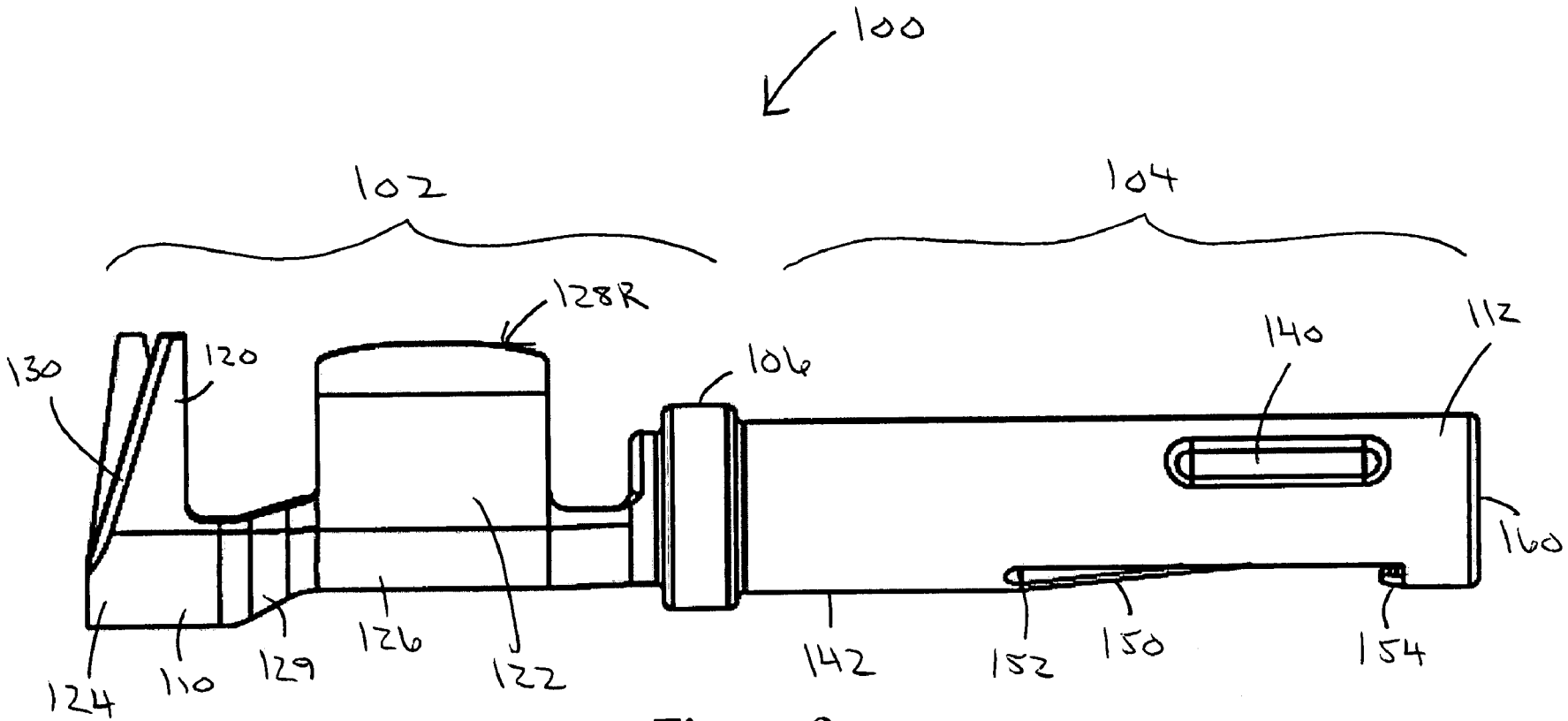
FIG. 2 is a side view of the socket contact of FIG. 1.
Figure 3:
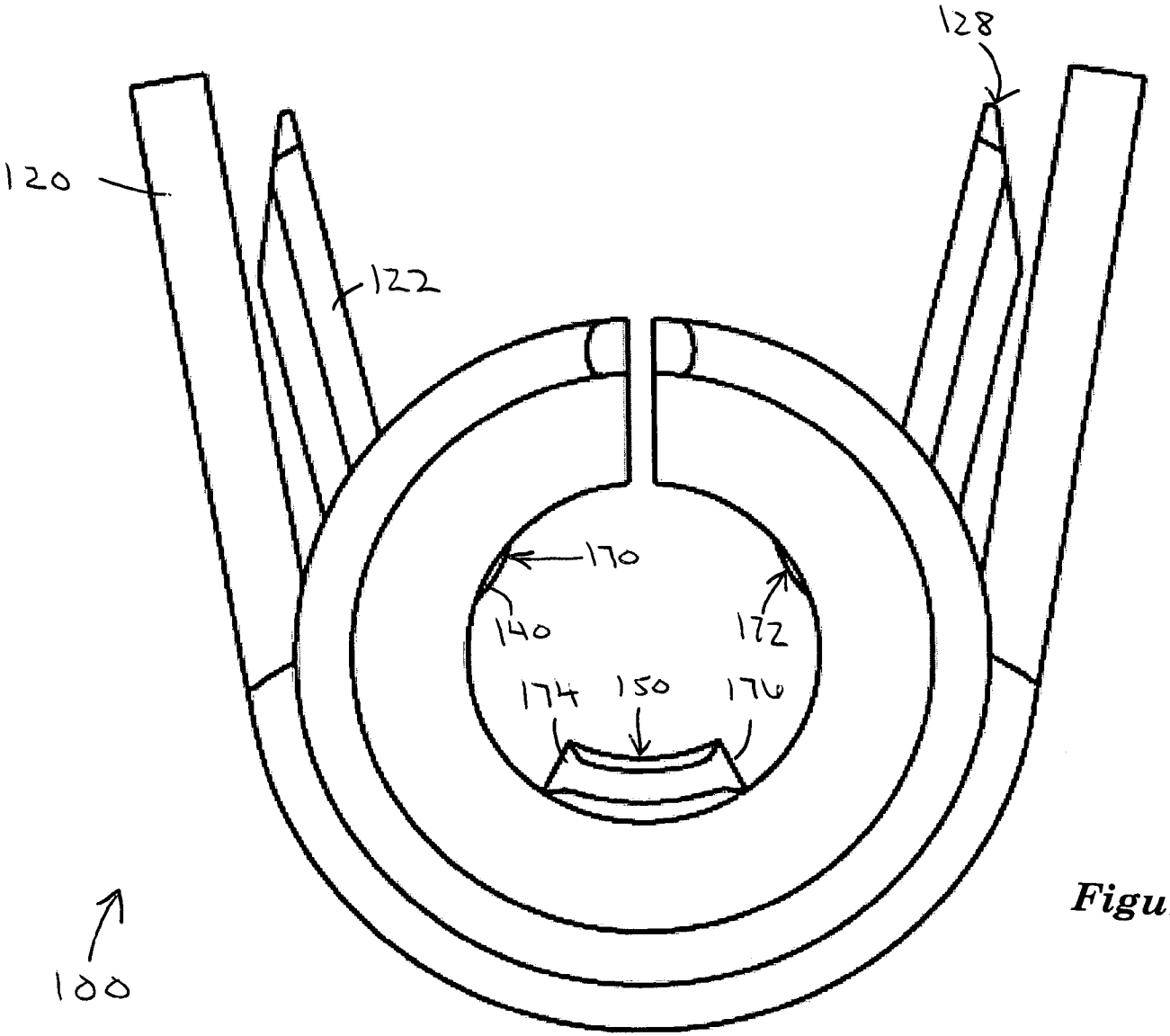
FIG. 3 is an end view of the socket contact of FIG. 1.

FIG. 1 is a top view of a socket contact 100 having a crimping section 102 and a flute section 104 separated by an integral locking collar 106. FIG. 2 is a side view of socket contact 100. FIG. 3 is an end view of socket contact 100.

In one embodiment, socket contact 100 comprises an electrical connection area that is adapted to receive and secure an exposed wire at a crimping end 110 and is further adapted to receive and engage a pin or plug within mating end 112. Crimping section 102 allows an exposed wire to be securely attached to crimping end 110 of socket contact 100, and flute section 104 allows a pin to be securely connected to a mating end 112 of socket contact 100.

Crimping section 102 includes insulation crimping members 120 that extend from a curved step-down portion 124. Insulation crimping members 120 are angular shaped and extend from portion 124 at an acute angle. This allows insulation crimping members 120 to wrap around the insulative portion of the wire with minimal interference from each other. In one aspect, insulation crimping members 120 are pliable enough to facilitate crimping of an insulative portion of a wire to crimping section 102 of electrical contact 100.

Crimping section 102 includes conductor crimping members 122 that extend from a curved base portion 126. Conductor crimping members 122 are quasi-rectangular shaped with semi-arched side crimp edges 128. In one aspect, conductor crimping members 122 are pliable enough to facilitate crimping of a conductive portion of a wire to crimping section 102 of electrical contact 100.

Curved step-down portion 124 and curved base portion 126 are formed as integral parts of crimping section 102 with a transition portion 129 positioned between portions 124, 126. Transition portion 129 is semi-conical in shape so as to evenly transition the diameter of curved step-down portion 124 and the diameter of curved base portion 126.

In general, many electrical wires include a conductive interior portion and an insulative exterior portion. The insulative portion of the wire may comprise a non-conductive material, such as plastic or resin, and the conductive portion of the wire may comprise a solid core or a plurality of strands of conductive material, such as metal. When preparing the wire for connection to socket contact 100, a portion of the insulation is stripped away from the conductor. The diameter of the insulation is at least greater than the diameter of the conductor alone. Therefore, curved step-down portion 124 of crimping section 102 allows for the greater diameter of the insulation of the wire, and curved base portion 126 of crimping section 102 allows for the smaller diameter of the conductor of the wire. Transition portion 129 of crimping section 102 integrally connects curved step-down portion 124 and curved base portion 126 together. Moreover, insulation crimping members 120, when crimped, secure the insulative portion of the wire to the socket contact 100, and conductor crimping members 122, when crimped, secure the conductive portion of the wire to the socket contact 100.

Flute section 104 includes fixed engagement members 140 that protrude inward from cylindrical outer sidewall 142. Engagement members 140 are formed as an integral part of flute section 104. Engagement members 140 are elongate, semi-cylindrical shaped protrusions on the interior surface of the flute section 104 and appear as recesses on the exterior surface of the flute section 104. Engagement members 140 may also be referred to as long-beam contact members, being parallel to the contact centerline.

Flute section 104 includes a resilient cantilever member 150 that bends inward from sidewall 142 at portion 152. Flute section 104 includes tab member 154 that limits outward deflection of resilient cantilever member 150 when a pin is inserted into the interior portion of flute section 104 at entry bezel 160. In one aspect, resilient cantilever member 150 functions as a spring device that biases the inserted pin against engagement members 140 so as to hold the pin in position within flute section 104, and tab member 154 prevents over-expansion of resilient cantilever member 150 so as to prevent deformation or skewing thereof.

In one aspect, engagement members 140 define an elongate area of contact 162 along their length and width. As shown in FIG. 3, engagement members 140 also define at least two fixed contact points or areas 170, 172, and the resilient cantilever member 150 defines at least two moving contact points or areas 174, 176. Thus, contact points or areas 170, 172, 174, 176 provide at least a four point contact or connection of socket contact 100 to a pin that is inserted into flute section 104. When the pin is inserted into flute section 104 of socket contact 100, resilient cantilever member 150 pushes the pin towards engagement members 140 so that the pin is trapped between contact areas 170, 172, 174, 176. This four point contact ensures an improved electrical connection between socket contact 100 and the pin for increased current carrying capacity.

Socket contact 100 is formed of a conductive material. For example, socket contact 100 may be formed of copper, copper alloy or various other highly conductive materials without departing from the scope of the present invention. A durable and corrosion-proof nickel plating and/or gold finish may optionally be applied. Socket contacts 100 may be stamped and pressed into form from flat strip stock and sold on reels with a plurality of socket contacts.

Figure 4:
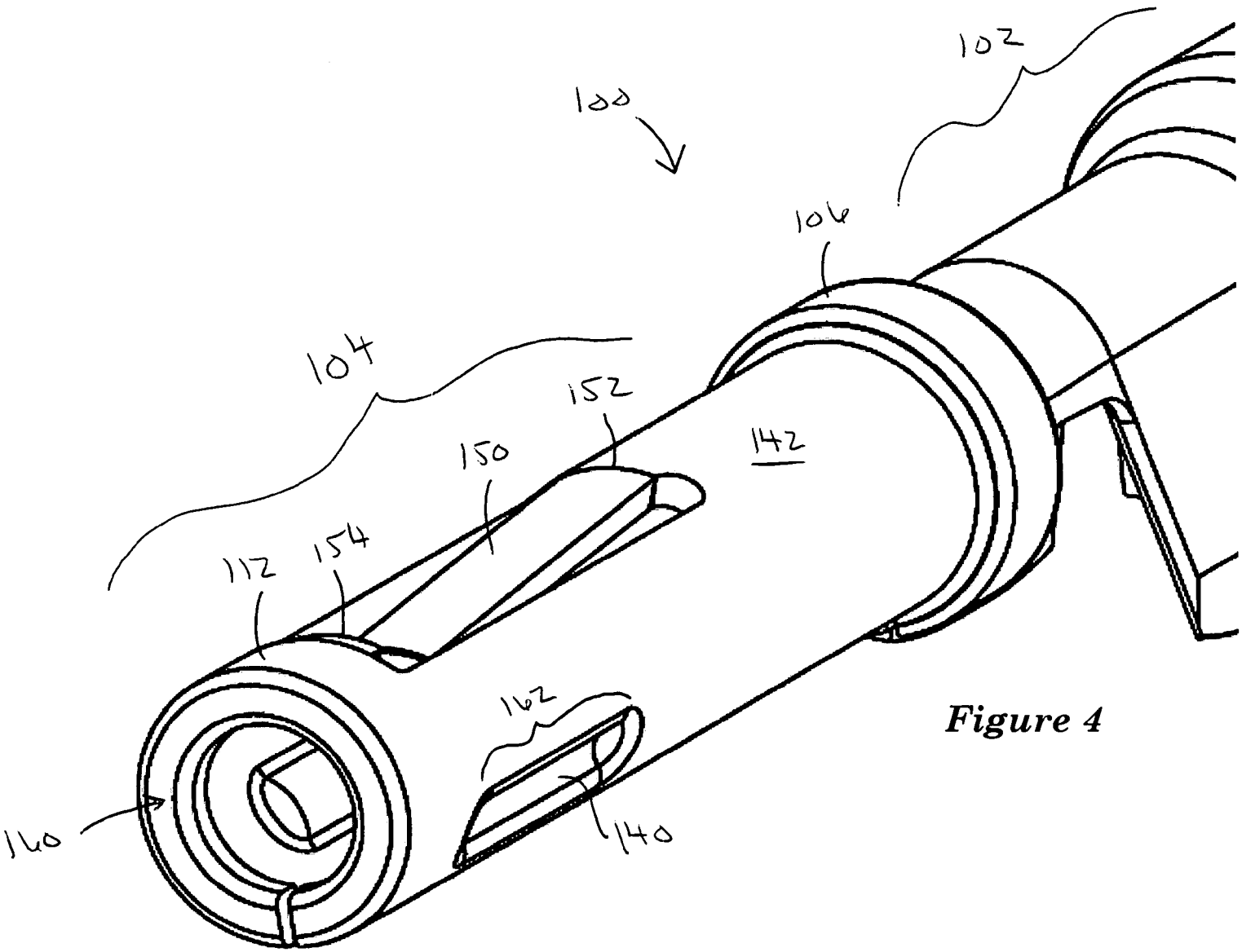
FIG. 4 is a perspective view of a mating end of the socket contact of FIG. 1.

FIG. 4 is a perspective view of mating end 112 of socket contact 100. As shown in FIG. 4, mating end 112 of socket contact 100 comprises entry bezel 160 with a reduced diameter, which protects contact engagement area, precludes oversized object socket damage, and increases strength of mating end 112.

Figure 5:
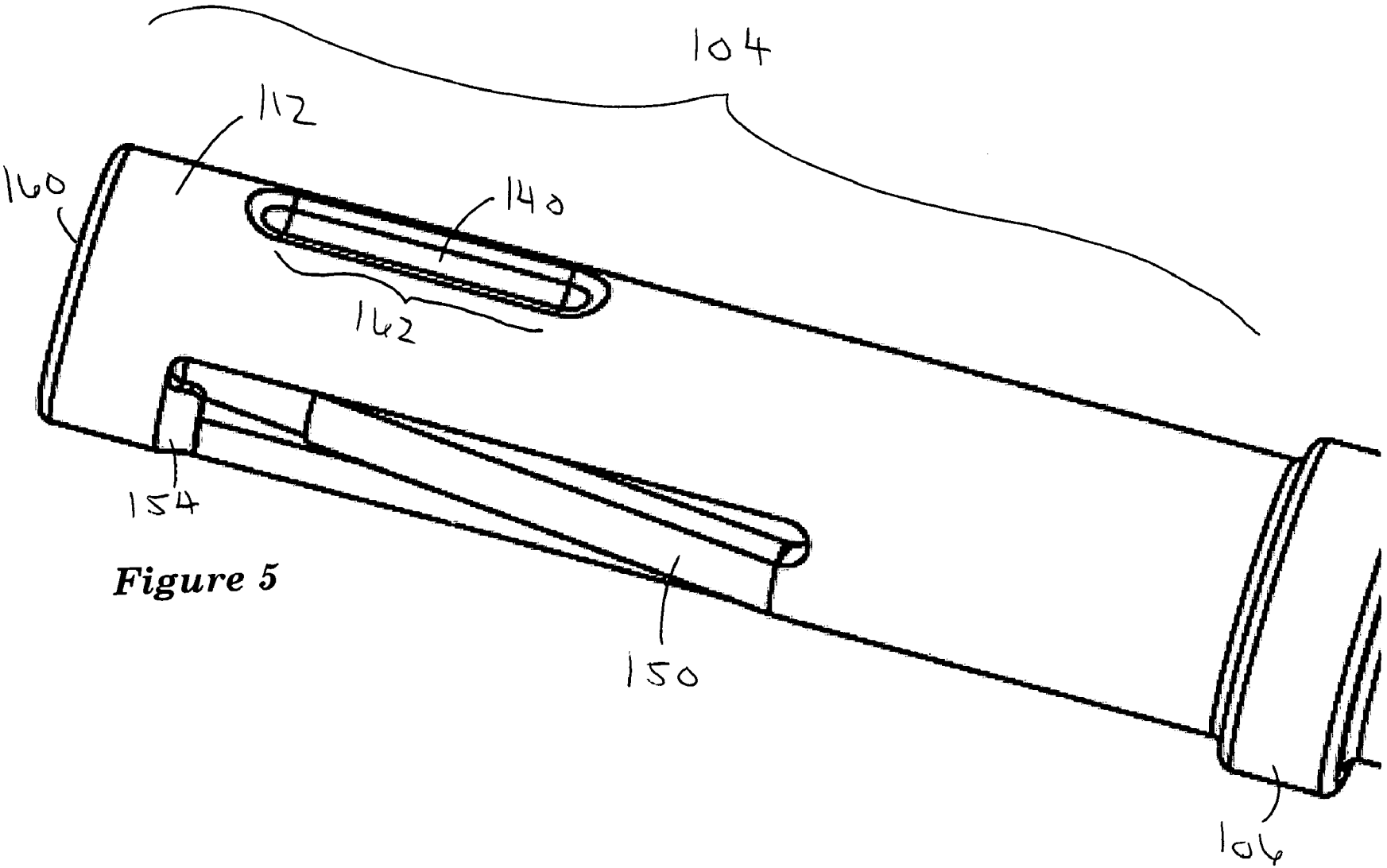
FIG. 5 is a perspective view of a flute section of the socket contact of FIG. 1.

FIG. 5 is a perspective view of flute section 104 of socket contact 100. As shown in FIG. 5, engagement members 140 provide an elongate contact zone 162, which engages a pin along its length for improved electrical connection between socket contact 100 and the pin. In one aspect, elongate engagement members 140 provide self-alignment for the pin when the pin is positioned within flute section 104 of socket contact 100. In addition, resilient cantilever member 150 biases the pin against engagements members 140 so as to secure the pin in position within flute section 104. Moreover, tab member 154 prevents deformation or over-expansion of resilient cantilever member 150 when the pin or a probing device is inserted into the interior portion of flute section 104.

Figure 6:
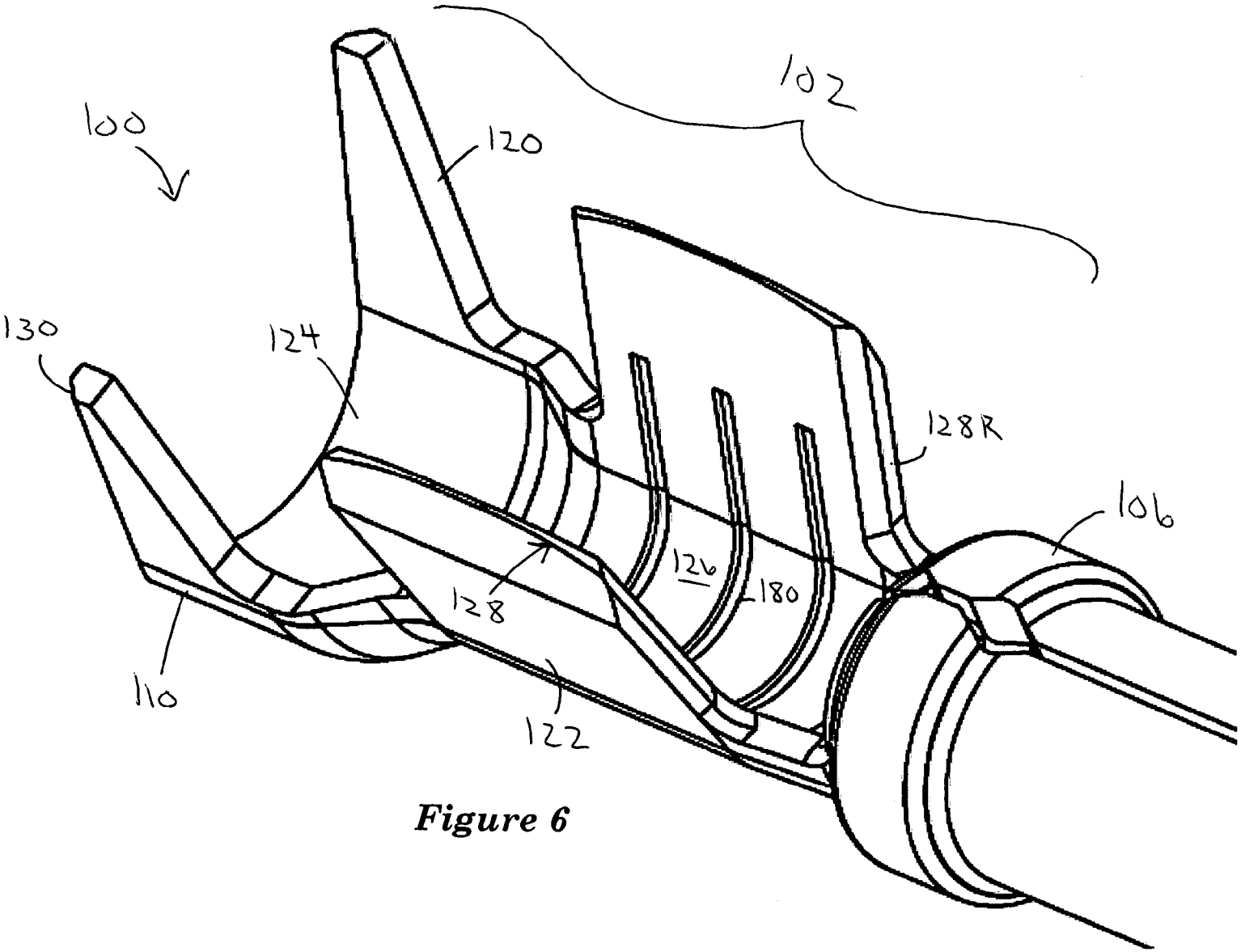
FIGS. 6 and 7 are perspective views of a crimping section of the socket contact of FIG. 1.
Figure 7:
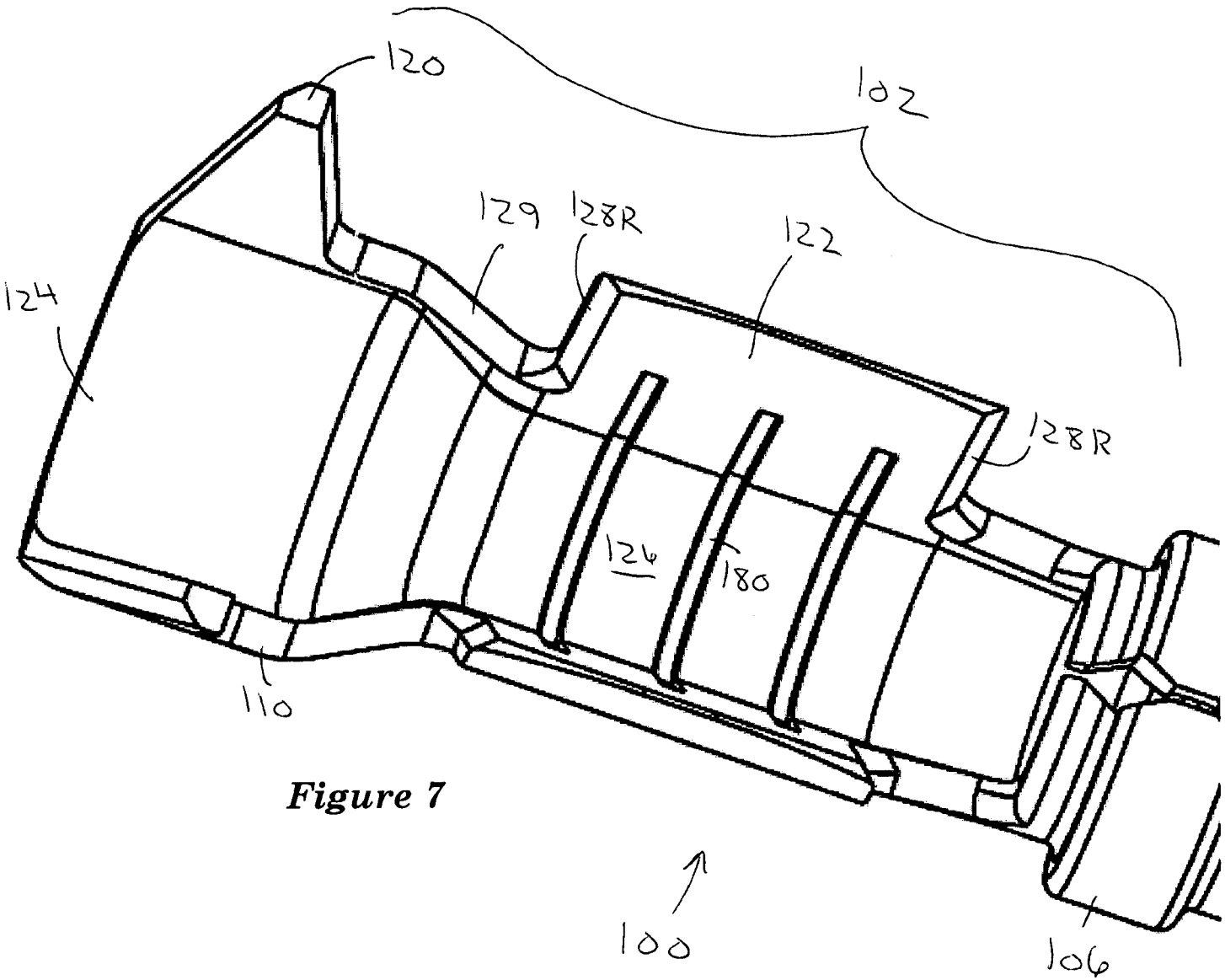

FIGS. 6 and 7 are perspective views of crimping section 102 of socket contact 100. As shown in FIG. 6, crimping members 122 include tapered entry edges 128R with compound curves to reduce entry forces during conductor strand crimping operations. Insulation crimping members 120 are angled in an opposing manner to facilitate overlap during a crimping operation with minimal collisions or skewing. Arched side crimp edges 128 of conductor crimping members 122 are tapered so as to prevent cutting of strands during a crimping operation and include reduced edge thicknesses 128R, such as edge-corner-breaks, to facilitate conductor strand crimping with reduced amputation of individual strands.

As shown in FIG. 7, base portion 126 of crimping section 102 includes a plurality of grooves or ribs 180 that can be either recessed or protruding. The depth of the recess or height of the protrusion is approximately 25% of the material thickness of base portion 126. In one aspect, grooves or ribs 180 grab wire that is crimped into position in crimping section 102 so as to prevent sliding movement of the wire after crimping.

The present invention provides many advantages. For example, the four point contact 170, 172, 174, 176 design of the socket contact 100 increases current carrying capacity of socket contact 100 and adds redundancy to improve vibration performance. Engagement members 140 provide at least two fixed long-beam contact points 170, 172, and resilient cantilever member 150 provides at least two moving contact points 174, 176. The reduced diameter of the entry bezel 160 prevents damage to contact surfaces from oversize object entry into socket contact regions. The self-alignment of the pin, when inserted into flute section 104, is achieved via the long-beam, high-strength fixed engagement members 140 and improves current carrying capacity. Flute section 104 does not require the use of a sleeve, which reduces cost and weight of socket contact 100. Arched side edges 128 of conductor crimping member 122 have tapered sides and compound curves to reduce entry forces during conductor strand crimping operation. The tapered side edges 128 of conductor crimping member 122 displace or spread individual conductor strands during entry instead of cutting them. The reduced edge thickness (edge-corner-break feature) of side crimp edges 128R of conductor crimping member 122 facilitates conductor strand crimping with reduced amputation of individual strands. Extended engagement contact zone 162 defined by the engagement members 140 reduces current density. The present invention also provides improved vibration tolerance via improved crimp design and contact points.

The description above refers to particular embodiments of the present invention and is intended to be illustrative rather than restrictive. Modification to the described embodiments may be made without departing from the spirit and scope of the invention as defined by the appended claims.

The invention claimed is:

1. An electrical contact comprising:

a crimping section for securing a wire comprising:

quasi-rectangularly shaped conductor crimping members that extend from a curved base portion to secure a conductive portion of the wire to the electrical contact, wherein a top edge of each of the conductor crimping members is both semi-arched and tapered with compound curves that reduce entry forces and reduce cutting of conductor strands during crimping;

insulation crimping members that extend from a curved step-down portion to secure an insulative portion of the wire to the electrical contact; and a transition portion integrally connecting the curved base portion and the curved step-down portion; and a flute section for receiving a pin, the flute section having fixed engagement members and a resilient cantilever member that biases the pin against the fixed engagement members to thereby hold the pin within the flute section.

2. An electrical contact as claimed in claim 1, wherein the insulation crimping members overlap with minimal collision when crimped into position around the insulative portion of the wire.

3. An electrical contact as claimed in claim 1, wherein the conductor crimping members further comprise a reduced edge thickness.

4. An electrical contact as claimed in claim 1, wherein the crimping section includes one or more grooves or ribs that prevent sliding movement of the wire after crimping.

5. An electrical contact as claimed in claim 1, wherein the fixed engagement members protrude inwards from sidewalls of the flute section.

6. An electrical contact as claimed in claim 1, wherein the fixed engagement members are elongate, semi-cylindrical shaped protrusions on the interior surface of the flute section and appear as recesses on the exterior surface of the flute section.

7. An electrical contact as claimed in claim 1, wherein the fixed engagement members define an elongate area of contact along its length and width.

8. An electrical contact as claimed in claim 1, wherein the fixed engagement members define at least two fixed contact points or areas.

9. An electrical contact as claimed in claim 1, wherein the resilient cantilever member bends inward from a sidewall of the flute section.

10. An electrical contact as claimed in claim 1, wherein the flute section includes a tab member that restricts the resilient cantilever member when the pin is received by the flute section.

11. An electrical contact as claimed in claim 1, wherein the resilient cantilever member defines at least two moving contact points or areas.

12. An electrical contact as claimed in claim 1, wherein the transition portion is semi-conical in shape so as to provide an even transition between the curved base portion and the curved step-down portion.

* * * * *